US008789654B2

(12) United States Patent
Campbell et al.

(10) Patent No.: US 8,789,654 B2
(45) Date of Patent: Jul. 29, 2014

(54) MAST LIFT WITH SCREW DRIVE AND GAS STRUT

(75) Inventors: Geoffrey George Campbell, Kensington (AU); Jason James Watson, Matraville (AU)

(73) Assignee: JLG Industries, Inc., McConnellsburg, PA (US)

( * ) Notice: Subject to any disclaimer, the term of this patent is extended or adjusted under 35 U.S.C. 154(b) by 154 days.

(21) Appl. No.: 13/191,676

(22) Filed: Jul. 27, 2011

(65) Prior Publication Data

US 2012/0043158 A1 Feb. 23, 2012

Related U.S. Application Data

(60) Provisional application No. 61/374,368, filed on Aug. 17, 2010.

(51) Int. Cl.
*E04G 1/22* (2006.01)

(52) U.S. Cl.
CPC ..... *E04G 1/22* (2013.01)
USPC ..... 182/141; 182/37; 182/142

(58) Field of Classification Search
USPC ..... 182/141, 148, 36, 37
See application file for complete search history.

(56) References Cited

U.S. PATENT DOCUMENTS 1,342,828 A 12/1915 Seymour
2,676,677 A * 4/1954 Anderson et al. ..... 92/137
2,762,659 A * 9/1956 Harlan et al. ..... 182/141
2,948,363 A * 8/1960 Hopfeld ..... 182/141
3,876,039 A 4/1975 Bushnell, Jr.
4,258,825 A 3/1981 Collins
4,427,093 A * 1/1984 Wehmeyer et al. ..... 182/141
4,427,094 A * 1/1984 Winkelblech ..... 187/233
4,458,786 A * 7/1984 Lebre ..... 187/231
4,592,447 A * 6/1986 Ream et al. ..... 182/127
4,752,102 A * 6/1988 Rasmussen ..... 297/344.2
4,875,555 A 10/1989 Johansson et al.
4,987,976 A * 1/1991 Daugherty ..... 187/243
5,044,473 A * 9/1991 Gripe ..... 187/244
5,111,907 A * 5/1992 Kishi ..... 182/69.4
5,143,181 A * 9/1992 Bixby ..... 187/242
5,203,425 A * 4/1993 Wehmeyer ..... 182/19
5,273,132 A * 12/1993 Sasaki et al. ..... 182/148

(Continued)

FOREIGN PATENT DOCUMENTS

DE 85 05 465 4/1985
EP 0 273 888 7/1988

(Continued)

OTHER PUBLICATIONS

U.S. Appl. No. 10/594,666, filed Sep. 28, 2006.

(Continued)

*Primary Examiner* — Alvin Chin Shue
*Assistant Examiner* — Colleen M Chavchavadze
(74) *Attorney, Agent, or Firm* — Nixon & Vanderhye P.C.

(57) ABSTRACT

A mast lift includes a base, a platform, and a lifting assembly connected between the base and the platform. The lifting assembly moves the platform between a lowered position and a raised position. A threaded driving rod is connected between the base and the lifting assembly, and a gas strut acts between the base and the lifting assembly and biases the lifting assembly and the platform toward the raised position.

13 Claims, 7 Drawing Sheets

(56) References Cited

U.S. PATENT DOCUMENTS

| | | | | |
|---|---|---|---|---|
| 5,425,433 | A * | 6/1995 | Huber | 187/225 |
| 5,624,046 | A | 4/1997 | Zimmermann | |
| 5,636,705 | A | 6/1997 | St. Germain | |
| 5,755,306 | A * | 5/1998 | Kraemer et al. | 182/148 |
| 5,803,204 | A * | 9/1998 | White et al. | 182/148 |
| 5,850,892 | A * | 12/1998 | Citron et al. | 182/148 |
| 5,890,559 | A * | 4/1999 | Busuttil et al. | 182/69.6 |
| 6,174,124 | B1 * | 1/2001 | Haverfield et al. | 414/642 |
| 6,206,059 | B1 | 3/2001 | Maakad et al. | |
| 6,471,004 | B2 | 10/2002 | Stringer et al. | |
| D570,071 | S | 5/2008 | Campbell et al. | |
| 7,497,140 | B2 | 3/2009 | Blackwelder et al. | |
| 7,614,459 | B2 | 11/2009 | Campbell et al. | |
| 7,762,532 | B2 | 7/2010 | Campbell et al. | |
| 7,766,750 | B2 | 8/2010 | Campbell et al. | |
| 7,896,366 | B2 * | 3/2011 | Campbell et al. | 280/43.17 |
| 8,292,039 | B2 * | 10/2012 | Campbell et al. | 187/261 |
| 2007/0125599 | A1 * | 6/2007 | Campbell et al. | 182/148 |
| 2008/0314690 | A1 | 12/2008 | Campbell et al. | |

FOREIGN PATENT DOCUMENTS

| | | |
|---|---|---|
| JP | 49-104354 | 10/1974 |
| JP | 63-168160 | 7/1988 |
| JP | 2-4900 | 1/1990 |
| JP | 2-159404 | 6/1990 |
| JP | 2-107337 | 8/1990 |
| JP | 3-100289 | 10/1991 |
| JP | 4-366050 | 12/1992 |
| JP | 5-69079 | 9/1993 |
| JP | 6-340398 | 12/1994 |
| JP | 57-46577 | 9/1995 |
| JP | 9-151088 | 6/1997 |
| JP | 2000-153995 | 6/2000 |
| JP | 2003-327393 | 11/2003 |
| JP | 2007-39227 | 2/2007 |

OTHER PUBLICATIONS

U.S. Appl. No. 11/581,785, filed Oct. 17, 2006.

U.S. Appl. No. 12/190,217, filed Aug. 12, 2008.

U.S. Appl. No. 12/293,759, filed Sep. 19, 2008.

Japanese Office Action dated Feb. 14, 2013 issued in Japanese Patent Application No. 2011-178048 and English translation, 6 pp.

Japanese Office Action dated Dec. 3, 2013 issued in Japanese Patent Application No. 2011-178048 and English Translation, 4 pp.

Japanese Office Action mailed Feb. 25, 2014 issued in Japanese Patent Application No. 2013-524956 and English Translation, 10 pp.

* cited by examiner

MAST LIFT WITH SCREW DRIVE AND GAS STRUT

CROSS-REFERENCES TO RELATED APPLICATIONS

This application claims the benefit of U.S. Provisional Patent Application Ser. No. 61/374,368, filed Aug. 17, 2010, the entire content of which is herein incorporated by reference.

STATEMENT REGARDING FEDERALLY SPONSORED RESEARCH OR DEVELOPMENT (Not Applicable)

BACKGROUND OF THE INVENTION

The present invention relates to a personnel lift and, more particularly, to a portable lift machine including a work platform raised and lowered by a lifting system. The LiftPod® system by JLG Industries, Inc. has been described in U.S. patent application Ser. No. 10/594,666, U.S. patent application Ser. No. 11/581,785, U.S. patent application Ser. No. 12/190,217, U.S. patent application Ser. No. 12/293,759, U.S. Pat. No. D570,071, U.S. Pat. No. 7,614,459, U.S. Pat. No. 7,762,532, and U.S. Pat. No. 7,766,750. See also www.LiftPod.com. The contents of the referenced documents and website are incorporated by reference.

The ladder concept is several thousand years old. Existing ladders, however, can be cumbersome and difficult to maneuver. Additionally, conventional ladders can be unstable particularly on uneven ground, and a work area is limited to the user's reach.

Ladder companies are reluctant to develop powered mechanical products. It would be desirable, however, to develop a personnel lift that achieves many of the advantages of a ladder, e.g., can be set up and used by a single operator, lightweight, etc., while providing for greater stability and a larger working area in a portable powered machine.

Mast climbing platforms are known and typically include a mast that can be free-standing or supported by a wall or other support structure. However, existing mast climbers have minimum SWL loads of 1000 lbs and are not portable or operable by a single user due at least to their size. Vertical mast products and aerial work platforms include a moving platform and generally are also typically too large for portability and are very far from the many advantages provided by a ladder in terms of portability, low cost and ease of use.

To achieve portability, a light weight, reliable lift system mechanism is desirable to provide the functionality expected of a device which lifts personnel.

BRIEF SUMMARY OF THE INVENTION

A desirable feature of the LiftPod® system is its low weight and portability. A single operator can assemble the unit. The portable construction enables the single operator to carry it up stairs, load the unit in a truck bed, etc. The system incorporates a full platform with rails around the operator for security. Lift power can be provided via a cordless drill or a dedicated power pack.

The invention embodies a personnel lift system that is smaller in construction than the original LiftPod® system and lighter. The invention can serve as an alternative to step ladders (up to 1.8 m/6 ft.) and can incorporate extensions to achieve higher reach.

Gas struts may be provided to store energy in the lowered position and thereby reduce power requirements for the lift. The gas strut in combination with a screw thread (such as an acme screw) and cordless DC motor/battery can provide both the means to power and control the machine to lift and lower a person in the platform in a secure manner.

In an exemplary embodiment, a mast lift includes a base and a telescoping mast coupled with the base and extending upward from the base. The telescoping mast includes a support section fixed to the base and a movable section movably connected to and displaceable relative to the support section between a retracted position and an extended position. A platform is secured to the movable section. In addition, a first driving plate is secured to the support section, and a second driving plate is secured to the movable section. A threaded driving rod is connected between the first driving plate and the second driving plate, where the threaded driving rod is fixed to one of the first and second driving plates and movably threaded in an opening in the other of the first and second driving plates. A gas strut acts between the support section and the movable section and biases the movable section toward the extended position.

In one arrangement, an inside perimeter of the movable section may be larger than an outside perimeter of the support section, where the movable section is disposed over the support section. Moreover, the outside perimeter of the support section may be substantially T-shaped including a head section and a leg section, and the threaded driving rod and the gas strut may be disposed in the leg section of the T-shape. The T-shaped perimeter of the support section may define a bearing space on opposite sides of the leg section, where the mast lift further includes a bearing secured to each side of the support section and disposed in the bearing spaces, respectively. Still further, the movable section may include a bearing guide extending inward into each of the bearing spaces on the opposite sides of the leg section of the support section. The bearings are positioned between the bearing guides and an outer wall of the movable section.

The base may include an axle to which the support section is connected, a pair of base legs each secured to the axle on opposite sides of the support section, where the axle extends through the base legs, and a pair of wheels each secured to the axle on opposite sides of the support member. The may further include supporting feet disposed on ends of the base legs opposite from the axle.

The threaded driving rod may be fixed to the second driving plate and may be movably threaded in the opening in the first driving plate.

The mast lift may additionally include a power pack coupled with the threaded driving rod, where the power pack includes a rotatable socket assembly fixed at one end to the threaded driving rod. An opposite end of the rotatable socket assembly is engageable with a rotary drive source, which may be a hand-held power drill.

The platform preferably includes a safety rail and a gate, and an accessory may be connected to the platform.

In another exemplary embodiment, a mast lift includes a base; a platform; a lifting assembly connected between the base and the platform, the lifting assembly moving the platform between a lowered position and a raised position; a threaded driving rod connected between the base and the lifting assembly; and a gas strut acting between the base and the lifting assembly and biasing the lifting assembly and the platform toward the raised position.

The lifting assembly may be one of a telescoping mast lift and a double linkage parallelogram assembly. In the context of the double linkage parallelogram assembly, the threaded driving rod may include a base rod coupled to the base and a moving rod coupled to a linkage of the double linkage parallelogram assembly, where the moving rod is linearly displaceable relative to the base rod by rotating the base rod relative to the moving rod. The gas strut may also be connected between the base and a linkage of the double linkage parallelogram assembly.

In yet another exemplary embodiment, a mast lift includes a base, a platform, and a lifting assembly connected between the base and the platform and comprising one of a telescoping mast lift and a double linkage parallelogram assembly. The lifting assembly serves to move the platform between a lowered position and a raised position. A threaded driving rod is connected between the base and the lifting assembly and includes a socket assembly engageable with a hand-held power drill. A gas strut acts between the base and the lifting assembly and biases the lifting assembly and the platform toward the raised position. In the context of the telescoping mast, the threaded driving rod and the gas strut may be disposed inside the telescoping mast.

BRIEF DESCRIPTION OF THE DRAWINGS

These and other aspects of the invention will be described in detail with reference to the accompanying drawings, in which.

DETAILED DESCRIPTION OF THE INVENTION

Figure 2:
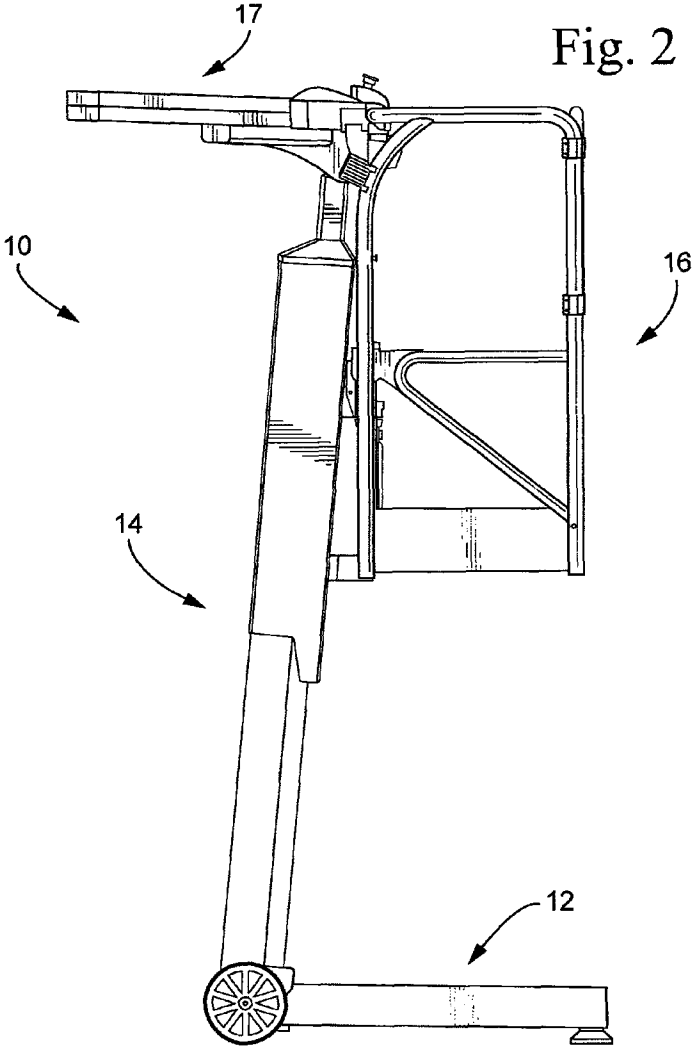
FIG. 2 is a side view of the assembled mast lift with the platform in a raised position.
Figure 1:
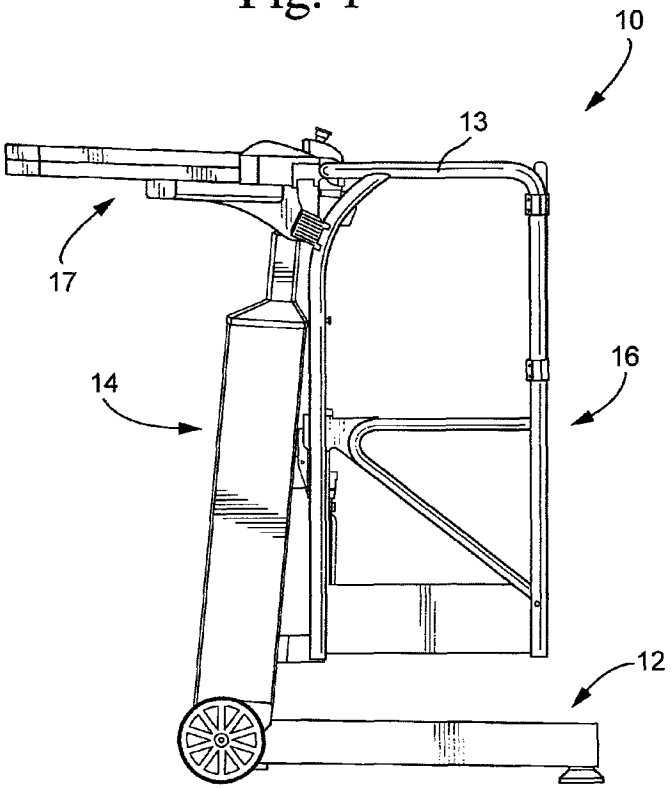
FIG. 1 is a side view of the assembled mast lift with the platform in a lowered position.

With reference to FIGS. 1-4, a mast lift 10 includes a base 12 and a telescoping mast 14 coupled with the base 12 and extending upward from the base 12. A platform 16 is secured to a movable section of the telescoping mast 14. A lifting assembly is connected between the base 12 and the platform 16 and moves the platform 16 between a lowered position (FIG. 1) and a raised position (FIG. 2). The platform 16 includes a safety rail 13 and a gate 15. Additionally, an accessory tray 17 may be connected to the platform 16. Other or alternative accessory items may be attached. For example, the design can be customized with specific accessories for a specific user purpose, i.e., the machine may designed such that it can accommodate a number of accessories specific to user requirements, including tool trays, buckets, drawers, paint trays, cleaning, and other accessories. These accessories may be attached to the mast, base or platform.

The telescoping mast 14 is provided with a support section 18 fixed to the base 12 and a movable section 20 movably connected to and displaceable relative to the support section 18 between a retracted position (lowered position shown in FIG. 1) and an extended position (raised position shown in FIG. 2). The platform 16 is secured to the movable section 20 of the mast 14.

Figure 3:
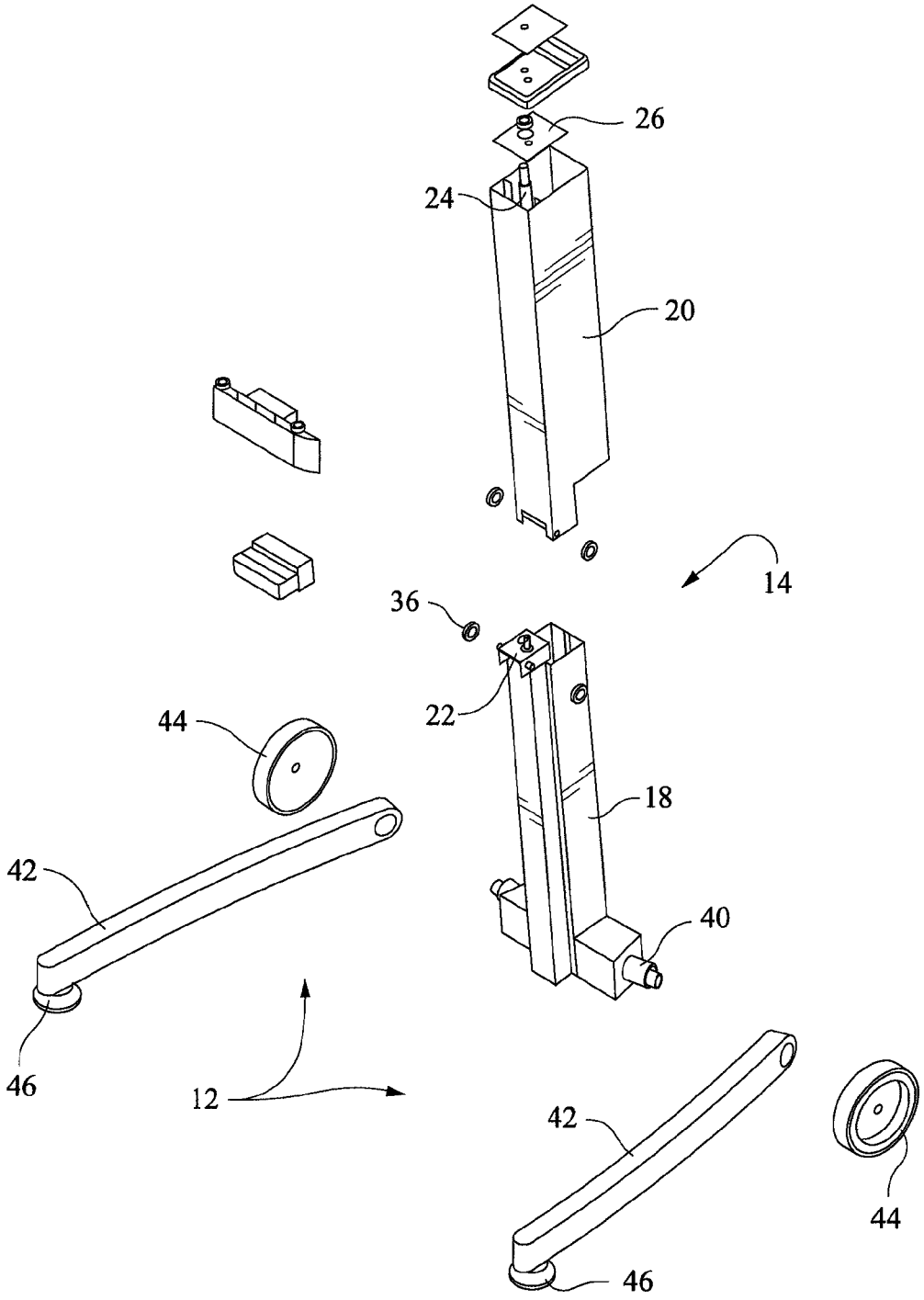
FIGS. 3 and 4 are exploded views showing parts of the mast lift.
Figure 4:
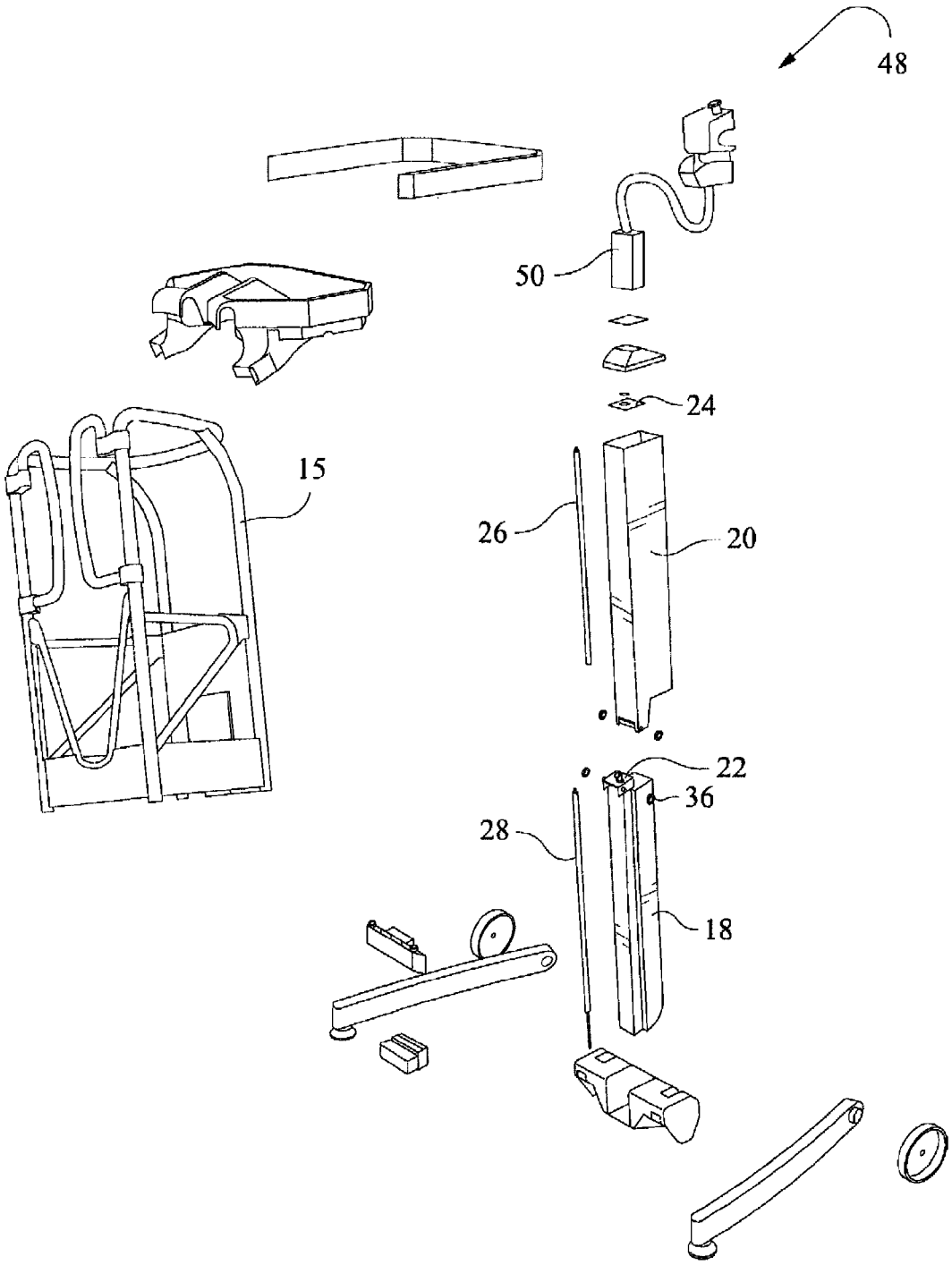

With reference to FIGS. 3 and 4, a first driving plate 22 is secured to the support section 18, and a second driving plate 24 is secured to the movable section 20. A threaded driving rod 26 (such as an acme screw) is connected between the first driving plate 22 and the second driving plate 24. That is, the threaded driving rod 26 is fixed to one of the first and second driving plates 22, 24 and is movably threaded in an opening in the other of the first and second driving plates 22, 24. In a preferred arrangement, the first driving plate 22 secured to the support section 18 includes the threaded opening or a bolt opening through which the threaded driving rod is movable by rotating the threaded driving rod 26. In this preferred arrangement, the rod 26 is fixed to the second driving plate 24 in the movable section 20 of the telescoping mast 14.

Those of ordinary skill in the art will appreciate alternative configurations for the drive construction, and the invention is not necessarily meant to be limited to the described and illustrated examples. For example, an alternative configuration could fix the threaded rod rotationally and drive the nut/threaded hole. In this context, the thread can be fixed to the lower section of the mast, whilst the nut is rotated and drives the machine up. The thread could similarly be fixed to the top section whilst driving the nut. To drive the nut, it may simply be a hollow tube with the drive shaft connected on top for matching to the drill/power pack.

A gas strut 28 acts between the support section 18 and the movable section 20 and is configured to bias the movable section 20 toward the extended position (platform raised position—FIG. 2). The gas strut 28 stores energy in the lowered position to thereby reduce the power requirements for the lift.

Figure 5:
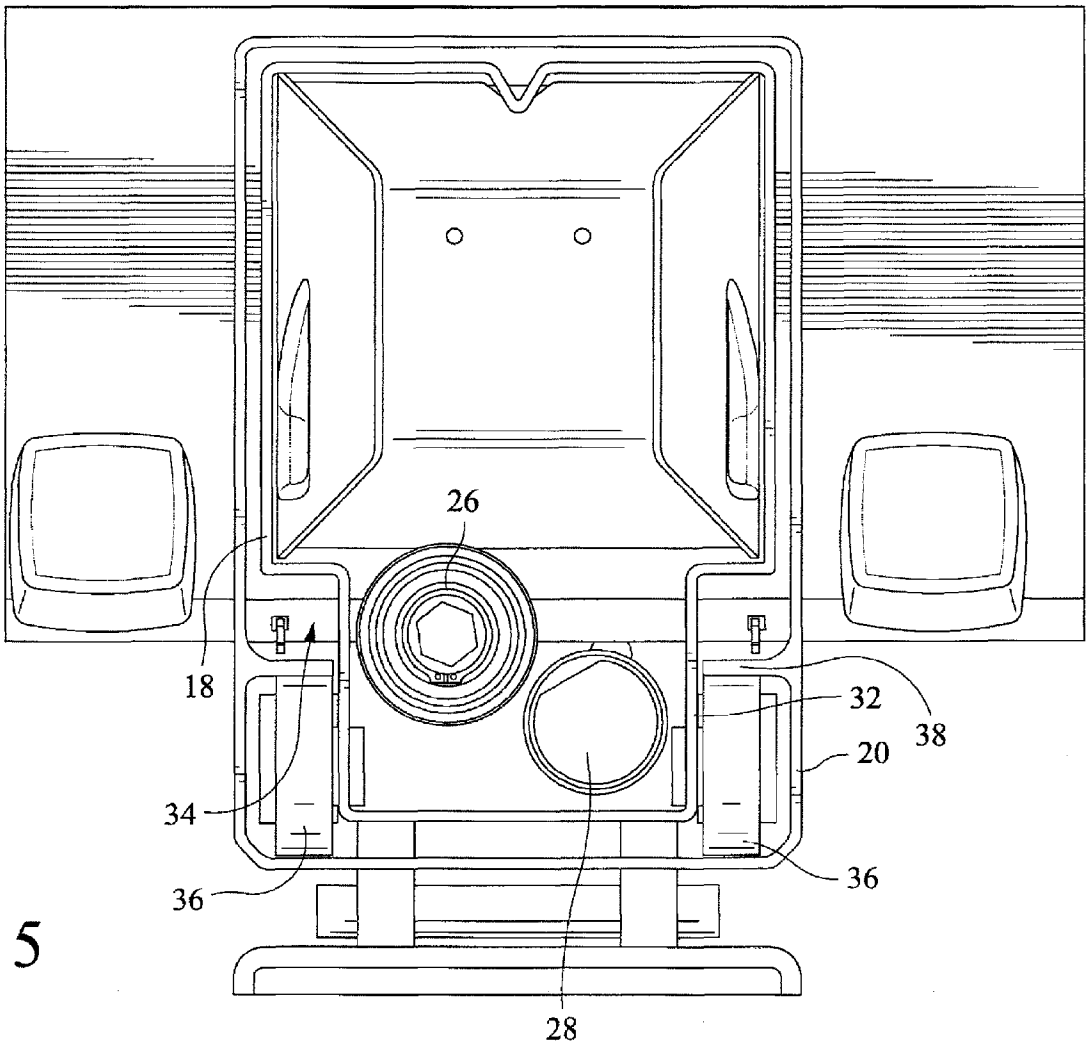
FIG. 5 is a top plan view looking into the telescoping mast.

With reference to FIGS. 3-5, in a preferred construction, an inside perimeter of the movable section 20 is larger than an outside perimeter of the support section 18, and the movable section 20 is disposed over the support section 18. As shown in FIG. 5, the outside perimeter of the support section 18 may be substantially T-shaped, including a head section 30 and a leg section 32. In this arrangement, the threaded driving rod 26 and the gas strut 28 are disposed generally in the leg section 32 of the T-shape. The T-shaped perimeter of the support section 18 defines respective bearing spaces 34 on opposite sides of the leg section 32. Bearings 36 are secured to each side of the support section 18 in the bearing spaces 34, respectively. The movable section 20 may be provided with a bearing guide 38 extending inward into each of the bearing spaces 34 on opposite sides of the leg section 32 of the support section 18. The bearings 36 are positioned between the bearing guides 38 and an outer wall of the movable section 20 as shown in FIG. 5.

With reference to FIG. 3, the base includes an axle 40 to which the support section 18 is connected. A pair of base legs 42 are secured to the axle 40 on opposite sides of the support section 18. The axle 40 extends through openings in the base legs 42. A pair of wheels 44 are respectively secured to the axle 40 on opposite sides of the support member 18 and through the base legs 42. Supporting feet 46 are disposed on ends of the base legs 42 opposite from the axle 40.

As shown in FIG. 4, the mast lift may additionally include a power pack 48 that is coupled with the threaded driving rod 26. The power pack includes a rotatable socket assembly 50 fixed at one end to the threaded driving rod 26 and is powered by a motor/gearbox assembly located inside the power pack 50. Alternatively, a user can power the device using a rotary drive source such as a hand-held power drill or the like by engaging the drill or a socket to the top of the drive shaft 26.

In use, with the mast lift 10 in a lowered position (FIG. 1), an operator can enter the platform 16 via the gate 15. The operator engages a hand-held power drill with the power pack 48 to drive the threaded driving rod 26. As the rod 26 is rotated, the rod 26 is displaced relative to the first driving plate 22 secured to the support section 18 of the telescoping mast 14. Since the opposite end of the rod 26 is fixed to the movable section 20 of the mast 14 via the second driving plate 24, the movable section 20 moves with the driving rod 26 and telescopes over the support section 18 toward the raised position (FIG. 2). The gas strut 28 assists in lifting the platform to thereby reduce power requirements for the lift. The platform 16 can be stopped in any position between the lowered position (FIG. 1) and the raised position (FIG. 2). Safeguards are provided to alert the operator when the platform has reached the maximum raised position. To lower the platform, the operation is reversed by reversing rotation of the threaded driving rod 26. The weight of the platform 16 and the operator is sufficient to contract the gas strut 28 without impeding the operator's ability to efficiently lower the platform 16.

Figure 6:
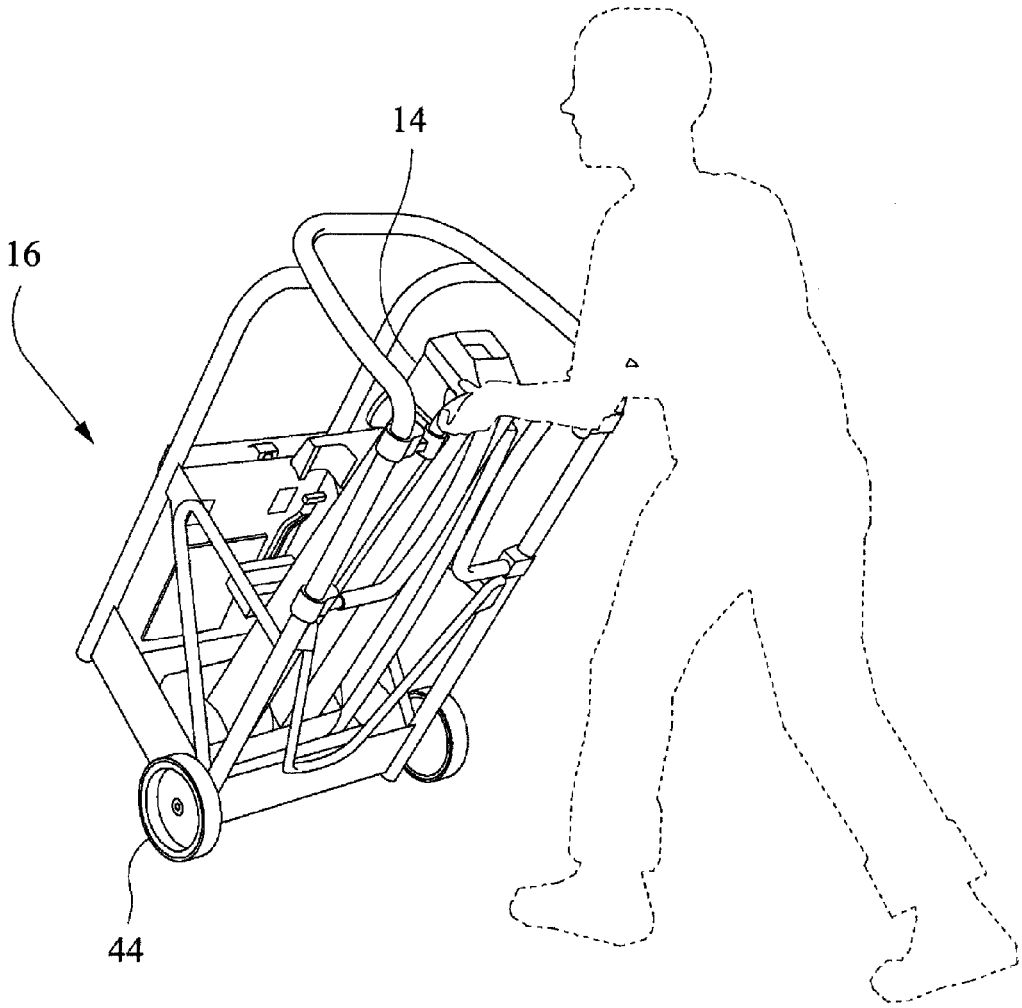
FIG. 6 shows a transport configuration of the mast lift.

The mast lift 10 is easily transported by a single user. For additional portability, the wheels 44 can be removed and placed onto the platform as shown in FIG. 6. The mast/base may also collapse and fit into the platform. With the wheels on the platform and the mast in the platform, the machine is even more transportable and can be used to cart tools etc. In addition, the mast lift may be provided with a self-propel attachment including powered wheels attachable adjacent a front end of the base 12. The self-propel attachment may be engaged and controlled by a user on the platform 16.

Figure 9:
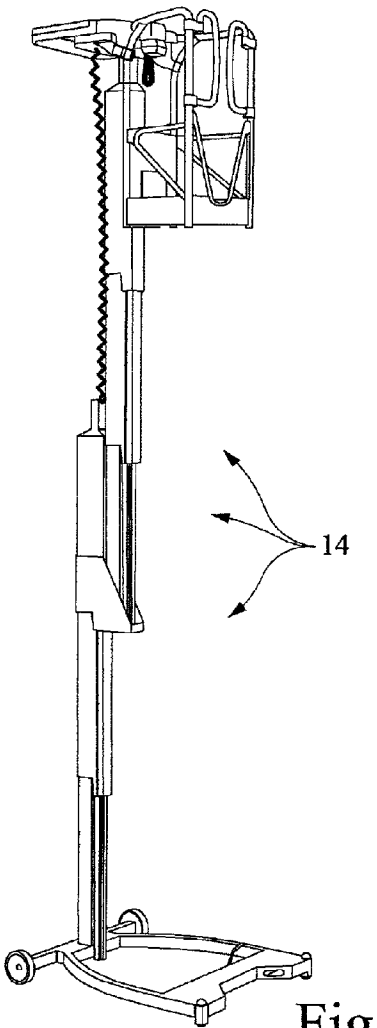
FIGS. 7-9 show alternative constructions utilizing modified mast components.
Figure 8:
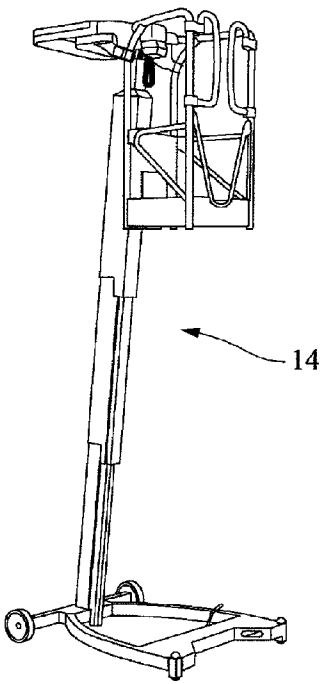
Figure 7:
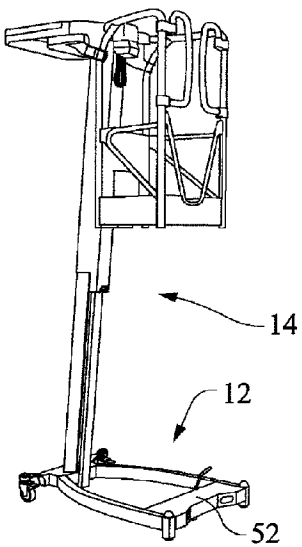

The maximum reach of the lift can be extended through the use of a longer support section 18 and movable section 20. Alternatively or additionally, the mast 14 may include one or more additional sections cooperable with the support section 18 and movable section 20. For example, see FIGS. 7-9 showing 6 ft, 8 ft and 14 ft versions, respectively, using modified mast sections. In some arrangements, the base 12 may also be modified to accommodate added support requirements. The 6 ft version is an extended version of the mast and drive used on the 4 ft version, but the bottom of the lower mast is hollow and matches to the square base stump. The 6 ft version thus does not have the "T" as described for the 4 ft, but is a hollow mast end. Additionally, the base 12 includes a cross member 52 connecting the legs of the base 12 as shown in FIG. 7. The 8 ft and 14 ft versions utilize a three-stage telescopic mast, which includes a telescopic acme drive.

Figure 12:
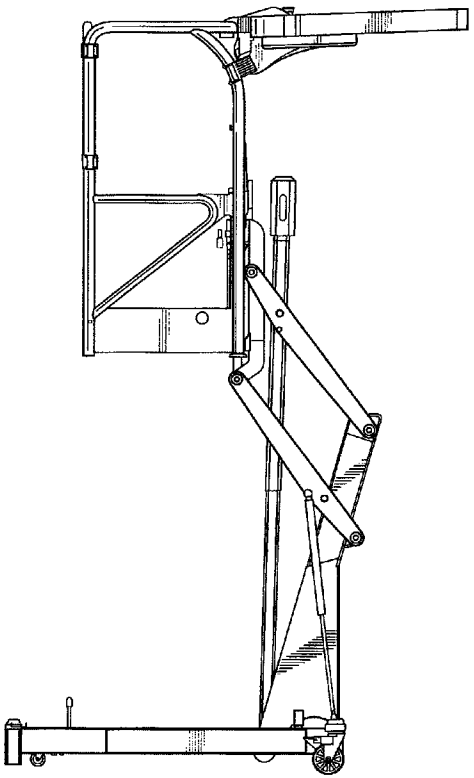
FIGS. 10-12 show an alternative mast lift embodiment using a double linkage parallelogram assembly.
Figure 11:
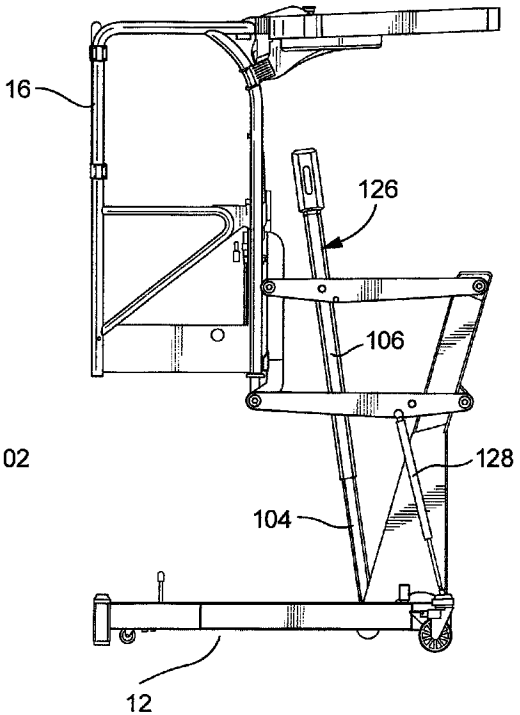
Figure 10:
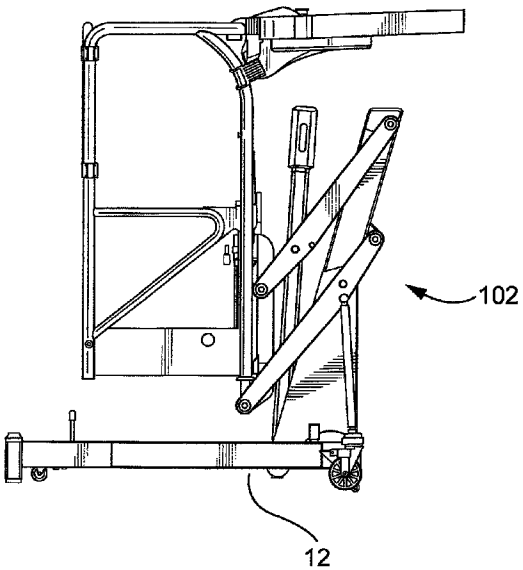

FIGS. 10-12 show an alternative embodiment of the mast lift. Instead of a telescoping mast, the lifting assembly includes a double linkage parallelogram assembly 102. In this embodiment, the threaded driving rod 126 includes a base rod 104 coupled to the base 12 and a moving rod 106 coupled to a linkage of the double linkage parallelogram assembly 102. The moving rod 106 is linearly displaceable relative to the base rod 104 by relative rotation between the base rod 104 and the moving rod 106. The gas strut 128 is connected between the base 12 and a linkage of the double linkage parallelogram assembly 102 as shown.

In use, after entering the platform 16, an operator engages the threaded driving rod 126 with a hand-held power drill. As the rod is rotated, the moving rod 106 is displaced linearly relative to the base rod 104, which causes the double linkage parallelogram assembly 102 to extend from the position shown in FIG. 10 toward the positions shown in FIGS. 11 and 12. The gas strut 128 facilitates lifting the platform 16.

The lightweight construction of the described embodiments provides the functionality of a ladder with added advantages. An operator can maintain two hands for working, with space for supporting tools and materials. The powered lift facilitates operator use and increases operator comfort. The platform provides added safety and maintains the operator center of gravity well inside a tipping line. This structure avoids typical set up and climb up risks of scaffolding.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A mast lift comprising:

a base;

a telescoping mast coupled with the base and extending upward from the base, the telescoping mast including a support section fixed to the base and a movable section movably connected to and displaceable relative to the support section between a retracted position and an extended position;

a platform secured to the movable section;

a first driving plate secured to the support section;

a second driving plate secured to the movable section;

a threaded driving rod connected between the first driving plate and the second driving plate, wherein the threaded driving rod is fixed to one of the first and second driving plates and movably threaded in an opening in the other of the first and second driving plates;

a gas strut acting between the support section and the movable section and biasing the movable section toward the extended position; and a power pack coupled with the threaded driving rod, the power pack including a rotatable socket assembly fixed at one end to the threaded driving rod, wherein an opposite end of the rotatable socket assembly is engageable with a rotary drive source and positioned for access from the platform; and wherein a top view outside perimeter of the support section is substantially T-shaped including a head section and a leg section, and wherein the threaded driving rod and the gas strut are disposed in the leg section of the T-shape.

2. A mast lift according to claim 1, wherein a top view inside perimeter of the movable section is larger than the top view outside perimeter of the support section, and wherein the movable section is disposed over the support section.

3. A mast lift according to claim 2, wherein the T-shaped perimeter of the support section defines a bearing space on opposite sides of the leg section, the mast lift further comprising a bearing secured to each side of the support section and disposed in the bearing spaces, respectively.

4. A mast lift according to claim 3, wherein the movable section comprises a bearing guide extending inward into each of the bearing spaces on the opposite sides of the leg section of the support section, wherein the bearings are positioned between the bearing guides and an outer wall of the movable section.

5. A mast lift according to claim 1, wherein the base comprises:

an axle to which the support section is connected;

a pair of base legs each secured to the axle on opposite sides of the support section, the axle extending through the base legs; and a pair of wheels each secured to the axle on opposite sides of the support member.

6. A mast lift according to claim 5, wherein the base further comprises supporting feet disposed on ends of the base legs opposite from the axle.

7. A mast lift according to claim 1, wherein the threaded driving rod is fixed to the second driving plate and is movably threaded in the opening in the first driving plate.

8. A mast lift according to claim 1, wherein the opposite end of the rotatable socket assembly is configured to be engaged with a hand-held power drill as the rotary drive source.

9. A mast lift according to claim 1, wherein the platform comprises a safety rail and a gate.

10. A mast lift according to claim 1, further comprising an accessory connected to the platform.

11. A mast lift comprising:

a base;

a platform;

a lifting assembly connected between the base and the platform, the lifting assembly moving the platform between a lowered position and a raised position;

a threaded driving rod connected between the base and the lifting assembly; and a gas strut acting directly between the base and the lifting assembly and biasing the lifting assembly and the platform toward the raised position, wherein a driving end of the threaded driving rod is positioned for access from the platform; and wherein a top view outside perimeter of the lifting assembly is substantially T-shaped including a head section and a leg section, and wherein the threaded driving rod and the gas strut are disposed in the leg section of the T-shape.

12. A mast lift according to claim 11, wherein the lifting assembly comprises a telescoping mast coupled with the base and extending upward from the base, the telescoping mast including a support section fixed to the base and a movable section movably connected to and displaceable relative to the support section between a retracted position corresponding to the lowered position of the platform and an extended position corresponding to the raised position of the platform.

13. A mast lift according to claim 12, wherein the lifting assembly further comprises:

a first driving plate secured to the support section; and a second driving plate secured to the movable section, wherein the threaded driving rod is connected between the first driving plate and the second driving plate, and wherein the threaded driving rod is fixed to one of the first and second driving plates and movably threaded in an opening in the other of the first and second driving plates.

* * * * *